US005748745A

United States Patent [19]

Bedini

[11] Patent Number: 5,748,745

[45] Date of Patent: May 5, 1998

[54] ANALOG VECTOR PROCESSOR AND METHOD FOR PRODUCING A BINAURAL SIGNAL

[75] Inventor: John C. Bedini, Coeur d'Alene, Id.

[73] Assignee: Bedini Electronics, Inc., Coeur d'Alene, Id.

[21] Appl. No.: 607,237

[22] Filed: Feb. 26, 1996

[51] Int. Cl.[6] ..... H04R 5/00

[52] U.S. Cl. ..... 381/1; 381/17

[58] Field of Search ..... 381/1, 22, 17, 381/18, 19

[56] References Cited

U.S. PATENT DOCUMENTS 5,274,708 12/1993 Fields ..... 381/1

5,333,201 7/1994 Waller ..... 381/22

*Primary Examiner*—Minsun Oh

*Attorney, Agent, or Firm*—Thomas G. Walsh

[57] ABSTRACT

An analog vector processor and method for converting right and left mono and stereo audio input signals through a series of six amplifier blocks and two control blocks using a series of unique signal path connections. The six amplifier blocks are comprised of three dual-amplifiers, two spacial amplifiers, a four-amplifier integrated circuit that inverts and transposes the signal path thus putting the signals out-of-phase. The two control blocks are comprised of a new and unique signal mixer control block that selects a mono, stereo, spacial or binaural signal, and a level control block for dual tracking of the signals. The resultant output signals are of an altered sound field producing a binaural effect thus creating a three-dimensional sound experience. The input signals may be from any sound source or conducting medium.

10 Claims, 18 Drawing Sheets

Signal Values and Input/Output Phase Degrees

| | Voltage | | KHz | | Phase Degree | |
|---|---|---|---|---|---|---|
| | input | output | input | output | input | output |
| Block 1 First duel-amp | 1.0 | 1.1 | 1.0 | 1.0 | 0 | 0 |
| Block 2 First spacial amp | 1.0 | 1.1 | 1.0 | 1.0 | 0 | 90° |
| Block 3 Control for mixing Blocks 1 & 2 (set to 50%) | 0.5 | 0.5 | 1.0 | 1.0 | 90° | 90° |
| Block 4 Four-amp integrated circuit | 0.5 | 2.0 | 1.0 | 1.0 | 90° | 180° |
| Block 5 Second spacial amp | 1.0 | 1.0 | 1.0 | 1.0 | 90° | 180° |
| Block 6 Second duel-amp (mixer amp) | 1.0 | 1.2 | 1.0 | 1.0 | 180° | 180° |
| Block 7 Level control (set to 50%) (laser-trimmed pot) | 1.2 | 0.5 | 1.0 | 1.0 | 180° | 180° |
| Block 8 Third duel-amp (buffer amp, no gain) | 0.5 | 0.15 | 1.0 | 1.0 | 180° | 180° |

FIG. 14

Circuit Block Component Values

Resistors

| | |
|---|---|
| 10K 1% | R1, R2, R7, R8, R34-37 (11) |
| 1.2K 1% | R3, R4, R31, R32 (4) |
| 100K 1% | R5, R6, R19, R20, R27, R28 (6) |
| 1K 1% | R9-16, R21-24, R38, R39 (14) |
| 100 1% | R25, R26, R29, R30 (4) |
| 20K 1% | R40 (1) |
| 15K 1% | R41, R42 (2) |
| 5K 1% | R43, R44 (2) |

Capacitors

| | |
|---|---|
| 10UF/35V | C1-16, C18-27 (26) |
| 0.47UF | C17 (1) |

Integrated Circuits

| | |
|---|---|
| NE5532 | U1-5 (5) |
| TDA3810 | U6, U7 (2) |

Potentiometers

| | |
|---|---|
| POT | RV1, RV2 (2) |

FIG. 15

Circuit Block Components

| | Resistors | Capacitors | Integrated Circuits | Potentiometer |
|---|---|---|---|---|
| Block 1 | R1-8 | C4,5,8,9 | U1:A,B | |
| Block 2 | R31-37 | C15-21 | U6 | |
| Block 3 | | | | RV1:A,B |
| Block 4 | R9-16 | C5, C6 | U2:A,B<br>U3:A,B | |
| Block 5 | R38-44 | C22-27 | U7 | |
| Block 6 | R17-24 | C7-10 | U4:A,B | |
| Block 7 | R25,26 | | | RV2:A,B |
| Block 8 | R27-30 | C11-14 | U5:A,B | |

FIG. 16

ANALOG VECTOR PROCESSOR AND METHOD FOR PRODUCING A BINAURAL SIGNAL

BACKGROUND OF THE INVENTION

1. Field of the Invention

The invention relates generally to audio circuits and more particularly to audio amplifier circuits and controls for processing an audio input signal through a series of amplifiers and controls to create a binaural signal that reproduces a realistic three-dimensional sound environment for the listener.

2. Description of Related Art and Information

The human hearing mechanism is not monaural but binaural in nature as the result of having two ears separated by the skull and influenced by the scalp, facial soft tissues and hair. With binaural hearing, a human can discern the locus of the sound heard thus locating its source. An emitting sound does not reach both ears simultaneously unless located at exactly the same distance from the individual ears.

In the early days of the recording industry, with the reproduction of sound such as voices, music and noise, a monaural (mono) recording system was all that was available. Thus, when recorded on a conducting medium and played back, the spacial sensations of depth, width and location were lost. There was no separation of the various sounds produced by instruments and voices, and therefore, it was as if the listener had only one ear or was monaural. The binaural sensation of hearing allows a person to orient him/herself by sound, not requiring sight, thus giving sound a natural, three-dimensional character even when artificially reproduced.

To further understand binaural hearing, consider a stadium filled with people, a marching band, cheer leaders and two football teams on the field. Place the listener on the 50 yard line in a middle row. As the sound of fans on the listener's right produces sound waves, it reaches the listener's right ear a split second sooner in time than the sound reaching the left ear. This difference in time in right and left hearing, which may be measured in microseconds, enables the listener to discern, without eyesight, the location of the sound as coming from the right. This split second difference in hearing by the right and left ears is referred to as a "phase change" and allows the listener to identify the location or "image" of the sound source.

If the sound wave has its source in the college marching band located on the 50 yard line opposite the listener, then the sound waves will reach the ears of the listener at approximately the same time thus allowing the listener to locate the sound source at "stage center".

If, in addition to the sound waves of the marching band, there is a loud explosion in the stadium parking lot opposite the listener, but behind the marching band, thus creating a second sound wave and heard by right and left ears at the same time, but slightly delayed, then the listener knows that the source of the second sound wave is positioned behind the source of the first sound wave in the stadium. If a corresponding phase change accompanies the reception of the first and second sounds, the listener is further able to determine whether the first and second signals are positioned to the left or right in the stadium. Therefore, when all of the sound waves emanating from sources all over the stadium are combined, the listener knows, without sight, that the stadium sounds have width and depth (spaciousness) and a locus or image as to where selected sources of sound are placed in the stadium. In most cases of "listening", a person can readily discern, separate-out and distinguish one sound source from another while identifying the sound's locus.

In contrast, in a monaural sound system with sound waves emitting from a single point source, the sound is not natural as it has no discernable depth, width or separation. In addition, imaging is not possible, because the sound waves emanate from the same location. While stereo and other multi-channel systems improve the quality of sound, the sound is not truly natural for imaging depth, width or separation, because the system is dependent upon the placement of audio speakers and the location of the listener.

The use of sound enhancement system circuitry is known in the art. U.S. Pat. No. 4,837,824 to Orban, *Stereophonic Image Widening Circuit,* uses a voltage controlled amplitude (VCA) circuit to control signals. The band pass filters allow certain frequencies to pass in the audio spectrum. The VCA controls the amplitude of the signal. These signals are pre-determined by the circuit voltages and set to certain levels by the VCA. There are no controls for mono, stereo, spacial or binaural signals. When the device receives left and right input signals, the signals are reduced to a mono signal. The mono signal is then subjected to VCA to determine the amplitude of the signal. The VCA then picks out a key frequency and then controls the level of the amplitude of that frequency. Orban does not claim, disclose or suggest a signal mixer control that is selective of a mono, stereo, spacial or binaural signal.

U.S. Pat. No. 4,489,432 to Polk, *Method and Apparatus for Reproducing Sound Having a Realistic Ambient Field and Acoustic Image,* is a duel-speaker system that uses cross-channeling in the amplifier speaker lines. Polk does not use any controls to mix L-R or R-L signals. There is a speaker cable that takes a portion of the right signal and locates it in the left speaker and a cable from the left speaker that goes to the right speaker. The device discloses a spacial relationship creating an ambient sound system with speakers having L-R, and R-L signal cross-over. Polk does not claim, disclose or suggest the signal path or signal mixer control disclosed in the instant invention.

U.S. Pat. No. 4,239,939 to Griffis, *Stereophonic Sound Synthesizer,* discloses a mono-source input network. There is a mono signal to stereo source. There is a basic stereo synthetic signal that is frequency-dependent, with amplitude versus frequency response curves. Griffis does not use a control to move frequencies nor is there a spacial control. This device splits the mono signal with high frequency on one channel and a low frequency on the other channel. The device uses a buffer system at the output of the processor but does not claim, disclose or suggest the signal path connections or the signal mixer control of the instant invention.

U.S. Pat. No. 5,440,638 to Lowe et al., *Stereo Enhancement System,* discloses a system of audio information that is common to both channels and is processed according to the audio frequencies. The signal is then fed through a placement filter to the right or left channel. There is no control for the placement filter as it is at a fixed level. There is no control for signal delay. There is a control for audio output levels. The filters are fixed. Lowe et al. does not claim, disclose or suggest a control for selecting a mono, stereo, spacial or binaural signal.

U.S. Pat. No. 4,748,669 to Klayman, *Stereo Enhancement System,* uses summing and deference circuits with the signals sent to a spectrum analyzer. The system is frequency-dependent and uses a Gain Controlled Amplifier. It has a signal-mixing stage but does claim, disclose or suggest a signal mixer control to select a mono, stereo, spacial or binaural signal.

SUMMARY OF THE INVENTION

The device of the instant invention is an analog vector processor and method that can receive mono, stereo or spacial input signals, wherein the signal, as processed along a signal path, is transposed and inverted out-of-phase to produce a binaural signal. The binaural signal results in a three-dimensional, realistic sound experience for the listener. The binaural processor and signal path connections is comprised of a series of six amplifier circuit blocks and two control blocks, one of which is a new and unique signal mixer control block, and a new and unique method of connecting the circuits of the processor, for producing a binaural sound.

BRIEF DESCRIPTION OF THE DRAWINGS

FIG. 14 lists the voltage, kilohertz and phase degree of the signal path from block one through block eight.

FIG. 15 is a list of components used with values for capacitors, resistors, integrated circuits and potentiometers.

FIG. 16 is list of components used in individual blocks.

DETAILED DESCRIPTION OF THE INVENTION

Figure 1:
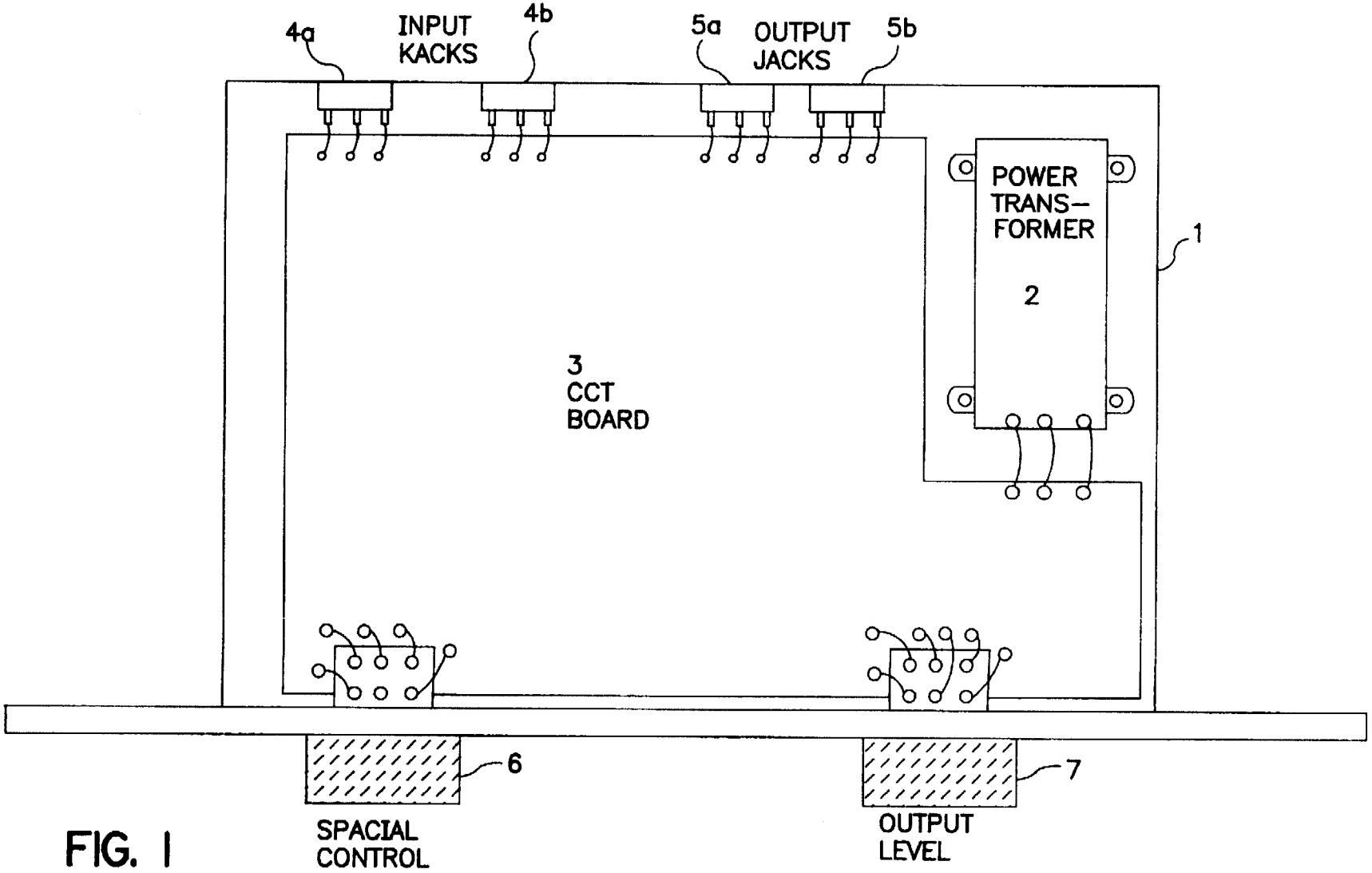
FIG. 1 is a perspective top view of a chassis housing of the analog vector binaural processor.

The instant invention is an analog vector processor and method for producing a binaural sound by converting right and left input mono, stereo or spacial signals into a binaural signal by connecting the signal paths through a series of eight blocks of amplifier circuits and controls. The eight blocks are comprised of three dual-amplifiers; two spacial amplifiers; a four-amplifier integrated circuit that processes the signal through an "X" circuit that inverts and transposes the signals, thereby resulting in signals out-of-phase; and two sets of controls. The resultant output signals are thus of an altered sound field resulting in a binaural signal producing a binaural sound field.

Input signals may be from any of several sound-producing sources such as a live performance, AM or FM radio, television, cassette tape player, digital audio tape machine, VCR, laser disc machine, AM and FM transmitters, microphones, audio CD or audio CD-ROM Multimedia player, or any other source of audio signal input medium.

Following input of the signal into the processor, there is a mono processing stage in which the left and right input signals are summed to form a left and right mono signal; and a spacial stage in which right and left signals are combined with near 180° relative phase and constant gain to produce left space and right space signals. Finally, there is a signal mixer stage in which the left mono and left spacial signals, and right mono and right spacial signals are mixed to produce a new left and a new right signal corresponding to a stereophonic signal of an altered sound field to produce a binaural sound field.

The processor of the instant invention uses a cross-over circuit referred to as the "X" circuit. The "X" circuit is comprised of four independent amplifiers working each in a specialized format in the sound spectrum. The anatomy and physiology of hearing, similar to eyesight, inverts and transposes traveling sound waves upon entry into the ear canal until final sound interpretation by the brain. In the development of the "X" circuit, the human hearing mechanism was reduced to electronic circuitry thus simulating the "circuitry" of human binaural hearing. The four independent amplifiers are connected in a signal-crossover manner to do the same thing: invert and transpose sound waves electronically.

Through this process, as sound waves are emitted from speakers, the sound is cast into the far corners of a room or space thus giving the perception that the sound is originating from a point other then the speakers. The sound, as perceived by the listener, appears to emanate from the precise location of the original source of live transmission.

The instant invention relates to the use of the "X" circuit; a new and unique signal mixer control block; and a new method by which the input/output signal paths of the individual amplifiers and controls are connected. This new method of connecting the amplifiers and control blocks does not require stereo circuits dependent upon normal (R+L) and normal (R−L) hook-ups, similar to other "three-dimensional" processors. With the use of regular stereo amplifier chips, the "X" circuit may be either coupled or placed in line after the first spacial block. The "X" circuit, like a command module, does the directing to the mixer circuit. The mixer circuit receives a new directed signal that may be amplified. The "X" circuit, like the process of human hearing, inverts and transposes the audio signal at electronic conducting speed.

The sense of hearing is a form of phase relationships. By inverting and transposing sound waves, the hearing mechanism reliably locates the sound source. The "X" circuit interprets sound waves electro-analytically, adds or subtracts phases and then inverts and transposes the signal to put it out-of-phase, mimicking the binaural hearing process. Because electronic circuitry reacts rapidly, as sound waves leave an audio speaker, they give the illusion that the sound is at a distance and away from the speaker. Actually, the source of the sound, during recording, is reproduced spatially in the same spot as originally recorded. For example, if a microphone is placed in the center of a busy intersection and traffic sounds are recorded using the processor of the instant invention, the playback will locate the sounds as they actually were during the recording process, or approximately 360° around the microphone (ears) for a 360° spacial relationship, even though the speakers are located "stage front" to the listener. The processor "folds" the sound around the listener's head at approximately 360°.

Figure 2:
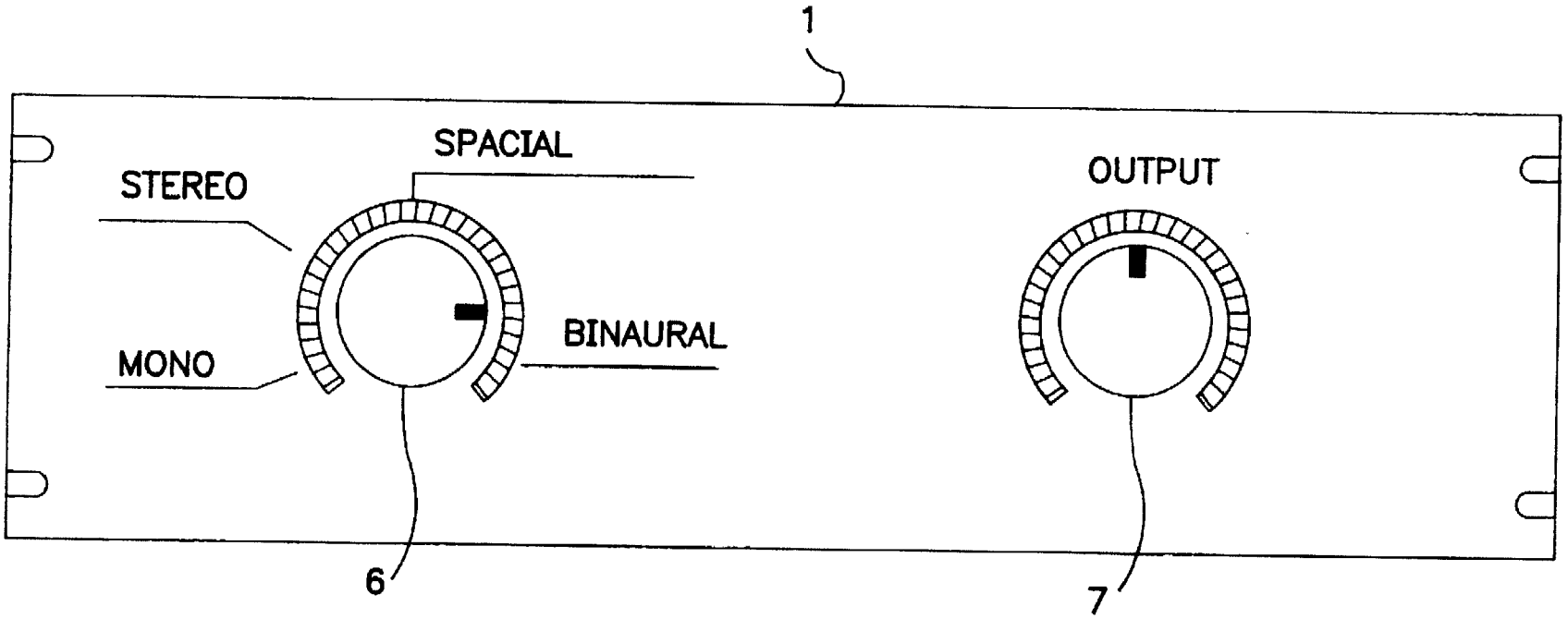
FIG. 2 is a perspective front view of the processor housing showing hand controls.
Figure 3:
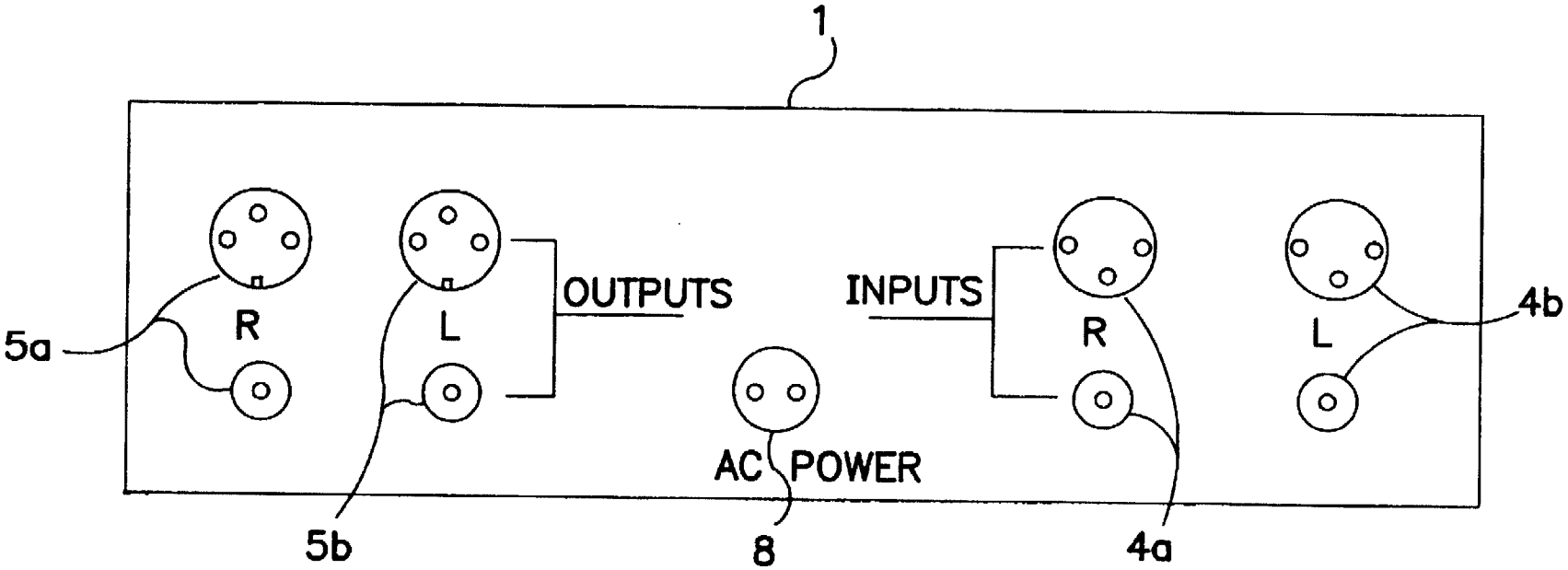
FIG. 3 is a perspective rear view of the processor housing showing input and output connections.

The binaural processor is contained in a housing as shown in FIGS. 1–3. FIG. 1 is a perspective top view of the processor 1 showing placement of power transformer 2, circuit board (CCT) 3, right input jack 4*a*, left input jack 4*b*, right output jack 5*a*, left output jack 5*b*, front spacial control dial 6 and front output-level control dial 7.

FIG. 2 is a perspective front view of the processor showing spacial control dial 6 with mono, stereo, spacial and binaural selections, and output-level control dial 7.

FIG. 3 is a perspective rear view of the processor showing right input jack 4*a*, left input jack 4*b*, right output jack 5*a*, left output jack 5*b* and AC power cord 8.

Figure 4:
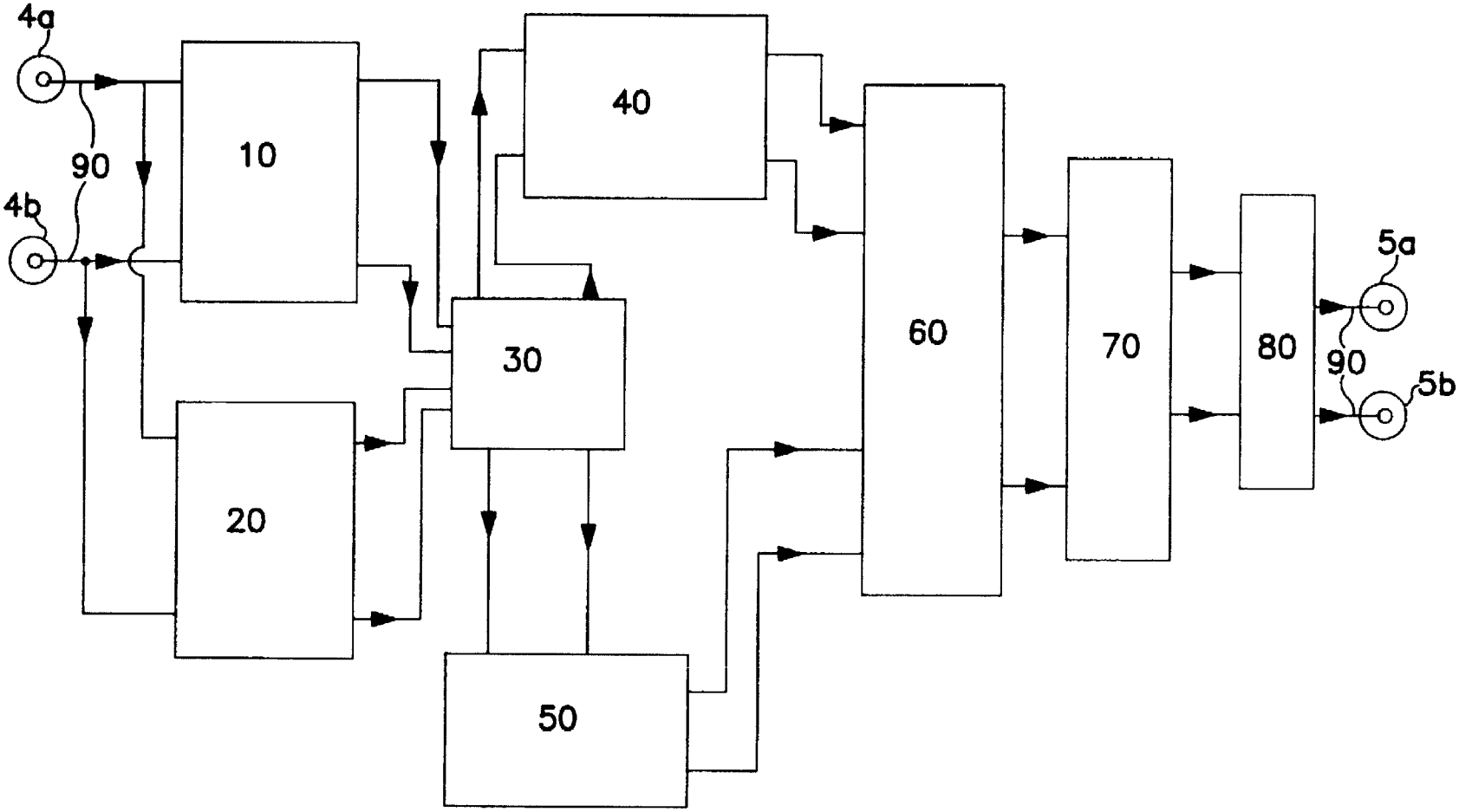
FIG. 4 is a block diagram of the amplifier and control blocks showing connecting signal paths of the processor circuits.

FIG. 4 is a block diagram of the processor comprised of input signal jacks 4*a* and 4*b*, amplifier circuit blocks 10, 20, 40, 50, 60 and 80, control blocks 30 and 70, signal path connections 90 and output signal jacks 5*a* and 5*b*.

Figure 5A:
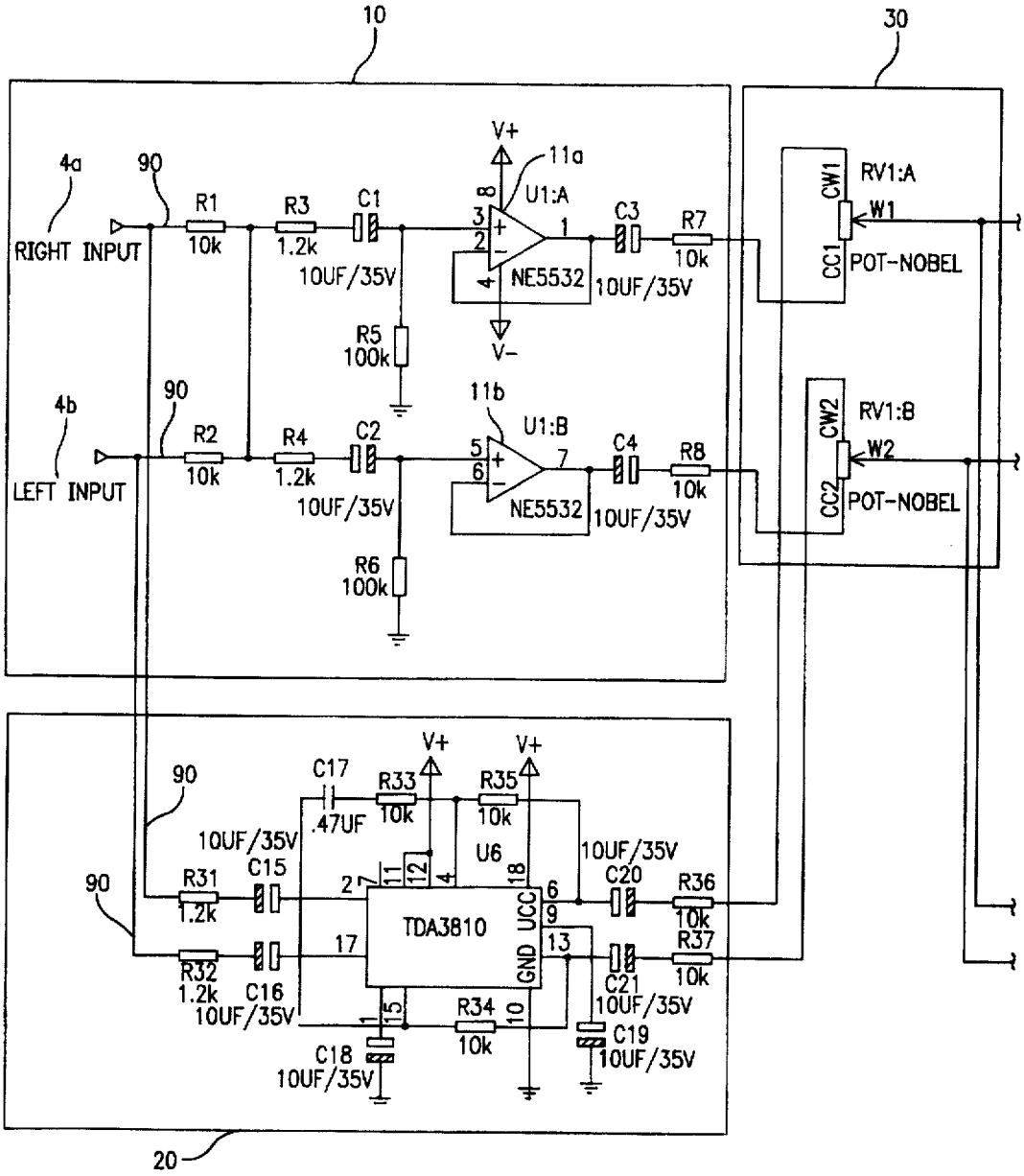
FIGS. 5*a*, 5*b* and 5*c* are schematic diagrams of the processor circuitry showing six circuit blocks, two control blocks and signal path connections.
Figure 5B:
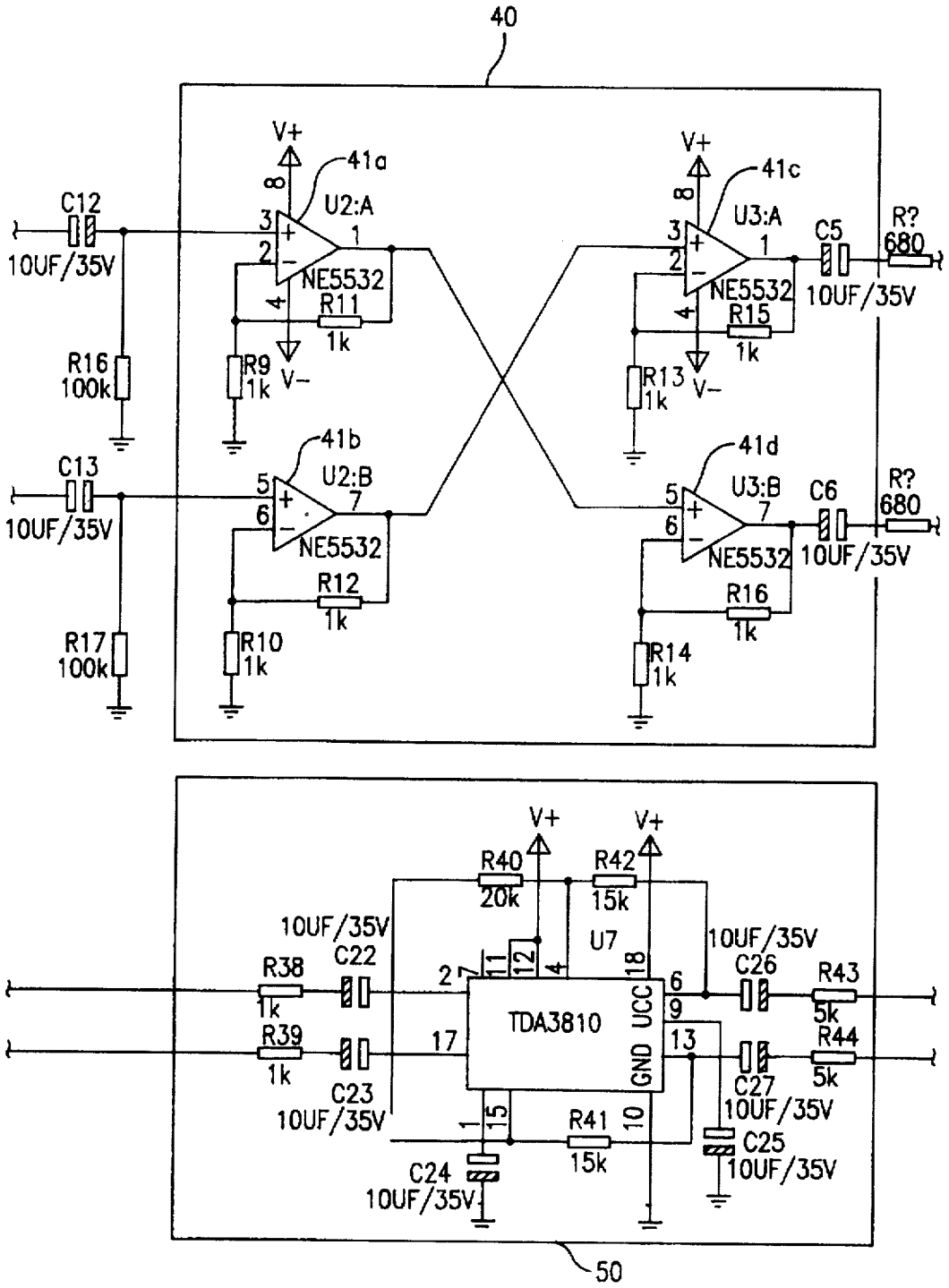
Figure 5C:
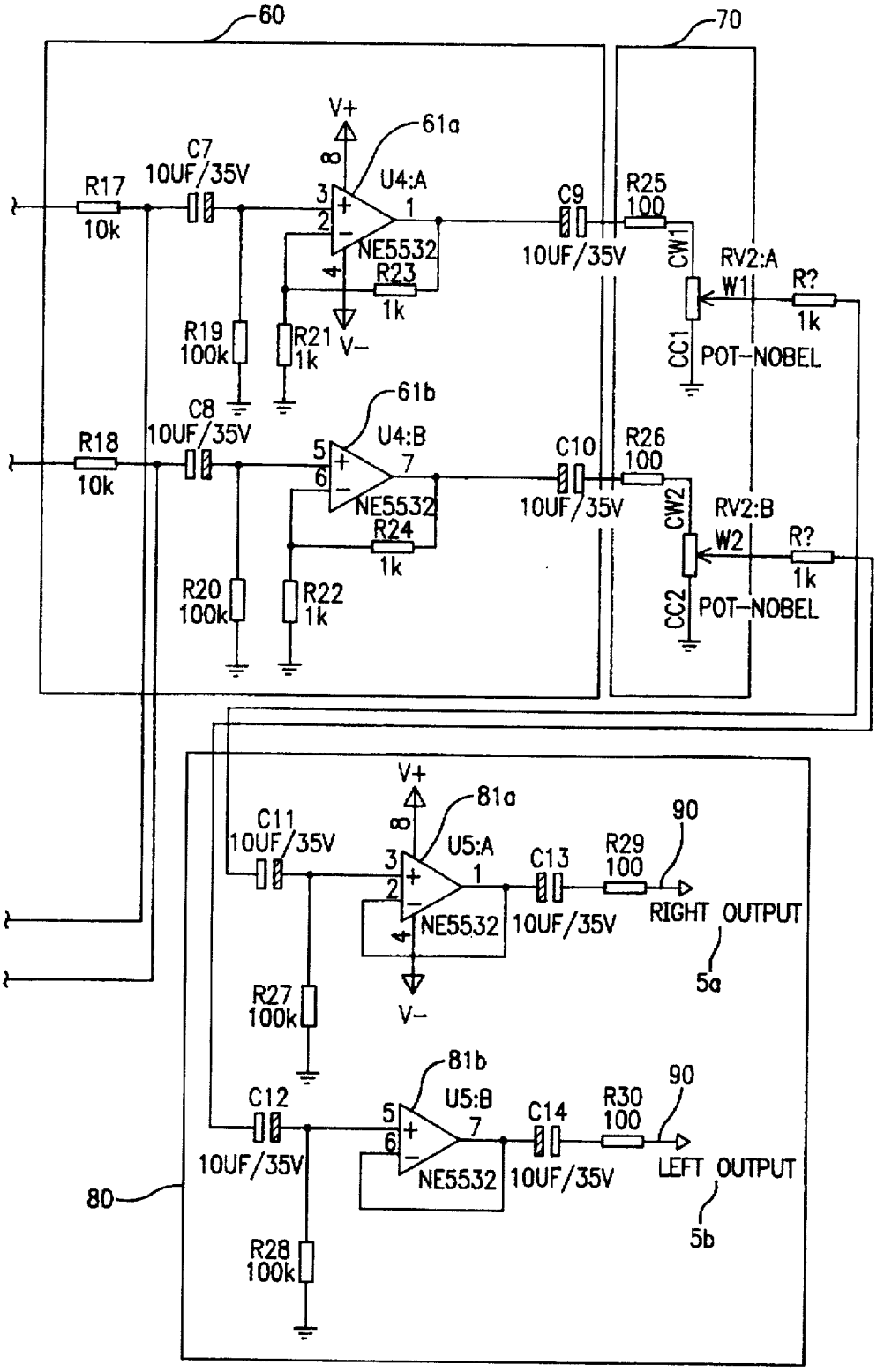
Figure 6:
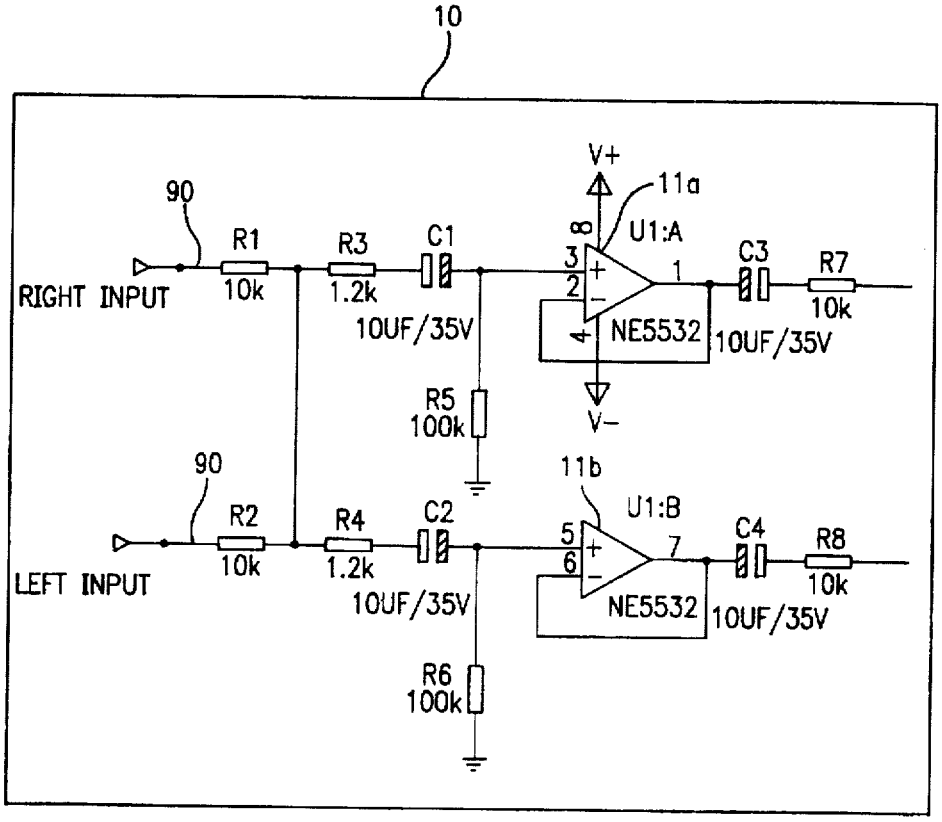
FIG. 6 is a schematic diagram of block one, a first dual-amplifier circuit.

FIGS. 5*a*, 5*b* and 5*c* is a schematic diagram of the six circuit blocks, two control blocks and signal path connections 90 comprising the CCT of the processor. Block one 10 is a first duel-amplifier integrated circuit comprised of two independent amplifiers 11*a* and 11*b* connected so that both channels produce a mono signal. Block one 10 receives input signals through 4*a* and 4*b*. FIG. 6 is an enlarged version of block one 10 showing location and value of capacitors and resistors, the two amplifiers 11*a* and 11*b*, and the signal path connections. The signal path of block one 10 is connected to block three 30, a signal mixer control block.

Figure 7:
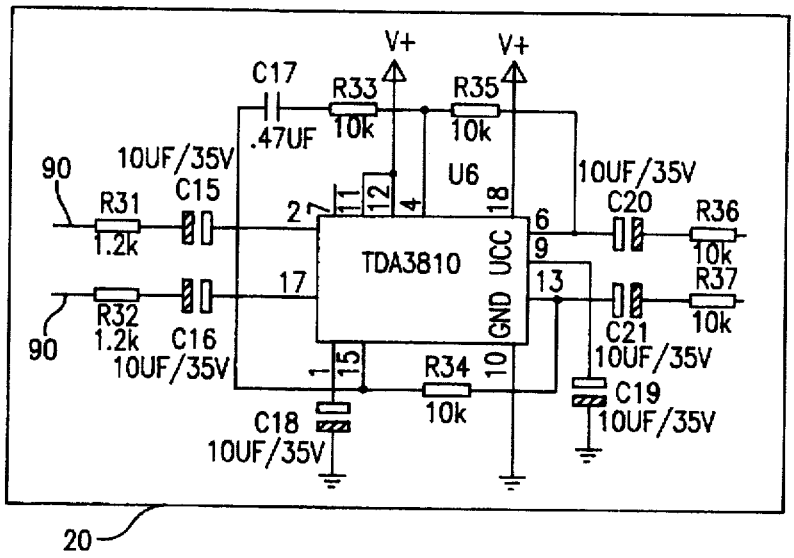
FIG. 7 is a schematic diagram of block two, a first spacial amplifier circuit.
Figure 8:
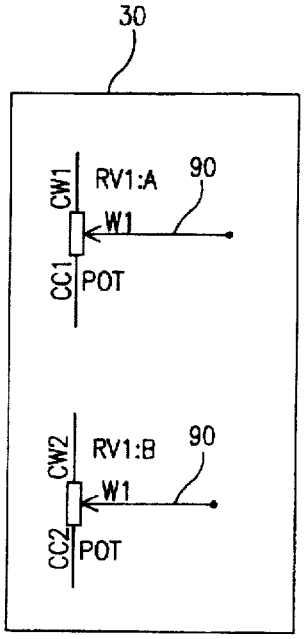
FIG. 8 is a schematic diagram of block three, a signal mixer control block.

Block two 20, the first spacial amplifier, is an integrated circuit developed by SIGNETICS, INC., which provides three switching functions to produce a mono, stereo or spacial signal. Block two 20 receives input signals through 4*a* and 4*b*. The signal is processed simultaneously through both block one 10, the first duel-amplifier, and block two 20, and is combined in block three 30, the signal mixer control block. Block three 30 has one control dial for selecting whether the signal will be expressed in a mono, stereo, spacial or binaural signal. FIG. 7 is an enlarged version of block two 20 showing location and value of capacitors and resistors, and the signal path connections. FIG. 8 is an enlarged version of block three 30 showing location and value of the potentiometers and the signal path.

Figure 9:
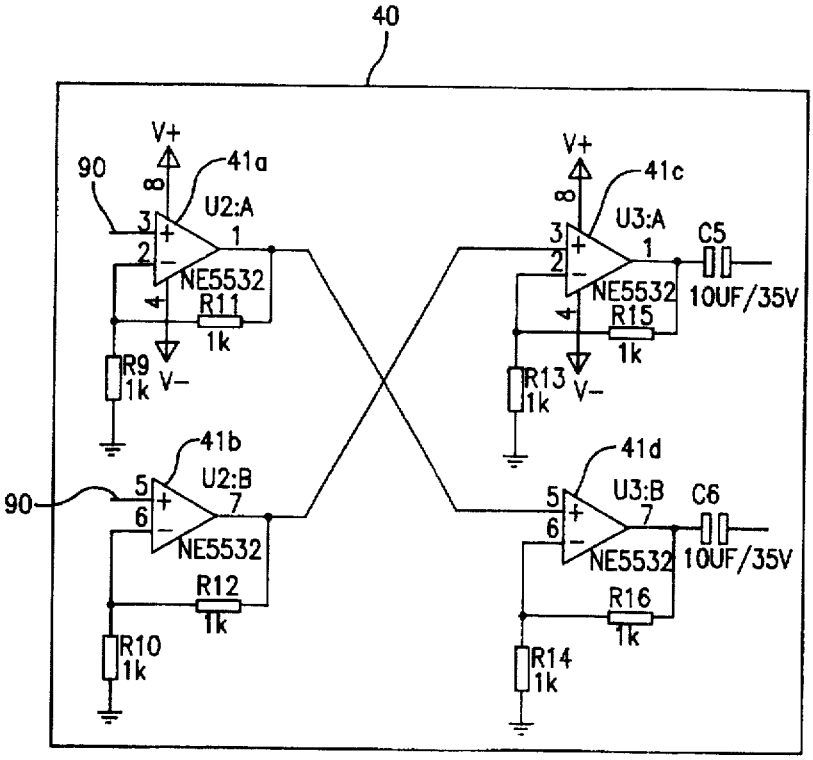
FIG. 9 is a schematic diagram of block four, a four-amplifier integrated circuit showing the "X" circuit.

Block four 40 is the "X" or cross-over circuit comprised of four independent amplifiers 41*a*, 41*b*, 41*c* and 41*d*. The circuits of block four 40 are integrated and arranged to invert and transpose the signals 0° to 180° out-of-phase, thereby adding 90° of shifting to the resulting signal, thus creating a range of approximately 360° of rotation. FIG. 9 is an enlarged version of block four 40 showing location and value of capacitors and resistors, the four independent amplifiers 41*a*, 41*b*, 41*c* and 41*d* of the "X" circuit and the signal path connections.

Figure 10:
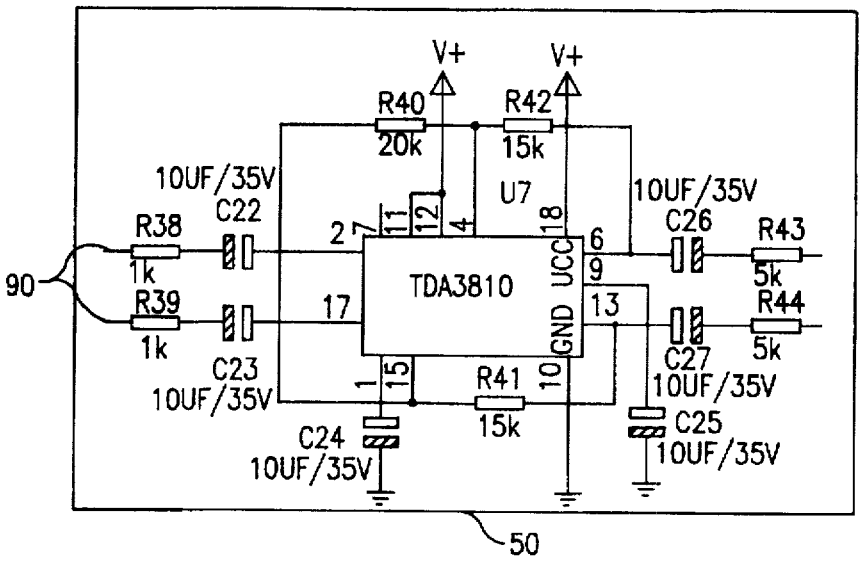
FIG. 10 is a schematic diagram of block five, a second dual-amplifier circuit.

Block five 50 is the second spacial amplifier and, like block two 20, is an integrated circuit developed by SIGNETICS, INC., providing the switching functions of either a mono, stereo or spacial signal. Block five 50 surrounds block four 40 and is fed into block six 60 as a spacial amplifier. FIG. 10 is an enlarged version of block five 50 showing location and value of capacitors and resistors, and the signal path connections.

Figure 11:
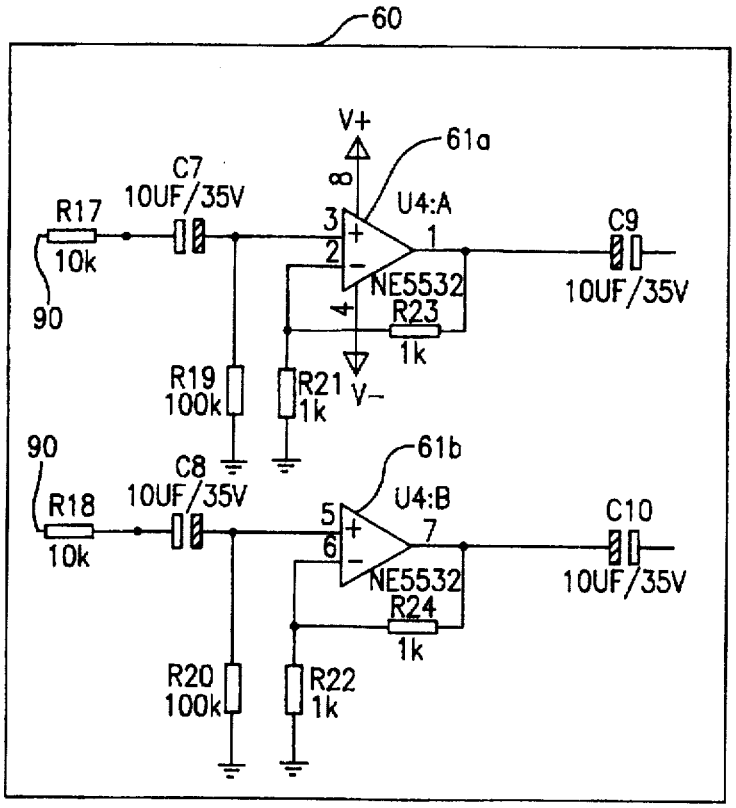
FIG. 11 is a schematic diagram of block six, a second spacial amplifier circuit.

Block six 60 is the second duel-amplifier comprised of two independent amplifiers 61*a* and 61*b*. Block six 60 is connected as an in-phase mixer amplifier to maintain phase integrity in right and left channels. FIG. 11 is an enlarged version of block six 60 showing location and value of capacitors and resistors, the two amplifiers 61*a* and 61*b*, and the signal path connections.

Figure 12:
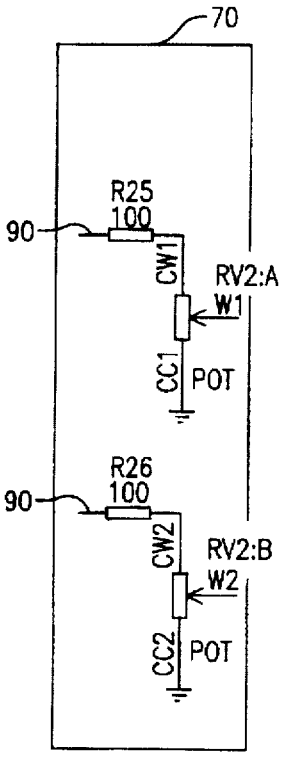
FIG. 12 is a schematic diagram of block seven, a level-control for dual-tracking of signals.

Block seven 70 is a level-control laser-trimmed potentiometer for dual tracking of signals. FIG. 12 is an enlarged version of block seven 70 showing location and value of resistors and potentiometers, and signal path connections.

Figure 13:
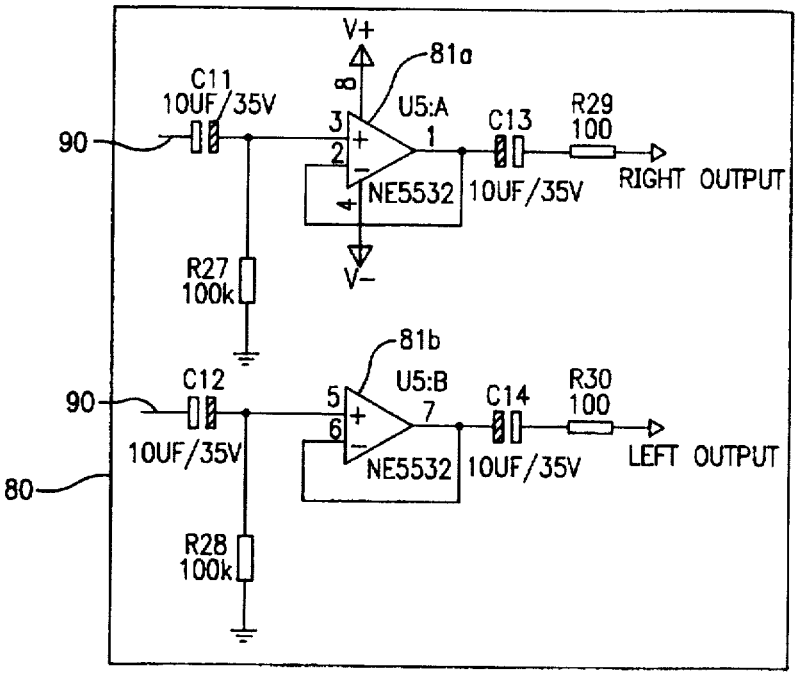
FIG. 13 is a schematic diagram of block eight, a third dual-amplifier circuit with signal outputs.

Block eight 80 is the third dual-amplifier comprised of two amplifiers 81*a* and 81*b* used as a buffer amplifier. Block eight 80 is the final amplifier in the circuit for the signal path and contains right channel signal output 5*a* and left channel signal output 5*b*. When a mono signal exits the output channel of block eight 80, it is in-phase with the signal source (input). When either a stereo, spacial or binaural signal exits block eight 80, it is out-of-phase with the signal source (input). FIG. 13 is an enlarged version of block eight 80 showing location and value of capacitors and resistors, the two amplifiers 81*a* and 81*b*, and signal path connections.

The six amplifier blocks, two control blocks and right and left signal paths of the processor must be connected in the order and method as described above and as shown in FIG. 5 schematic drawing. The "X" circuit of block four 40, the signal mixer control of block three 30 and the order and method of connecting block one through block eight are the unique features that comprise the invention.

The signal path from block one 10 and block two 20 are connected to signal mixer control block three 30. Control dial 6 is turned counter-clockwise to produce a mono signal; clockwise for stereo and spacial signals; and full clockwise for binaural signals. All signals are processed in block four 40. The signals then pass into block six 60, the mixer amplifier circuit for maintaining the phase integrity of the mixed signals. Block five 50 feeds into and is mixed in block six 60. Block seven 70 is a 100 k ohms laser-trimmed dual-control potentiometer. As signal path 90 passes through block seven 70, it feeds into block eight 80, the buffer amplifier. The phase integrity of the mixed signals is maintained is blocks six 60, seven 70 and eight 80.

FIG. 14 illustrates signal input and output as measured in voltage, Kilohertz (KHz) and phase degree as the signal path passes through block one to block eight of the processor. Input signals are out-of-phase in block two through block eight, except when control dial 6 is set on the mono setting of control block three 30, wherein the signals are in-phase. As the signal is processed through the first spacial amplifier, the signal goes out-of-phase and continues to be out-of-phase as it exits right channel output 5*a* and left channel output 5*b* of block eight 80. FIG. 14 illustrates only one example of a combination of signal input/output voltages and KHz. Voltages may range from 0.25 to 10 volts. KHz may range from 0.1 Hz to 100 KHz.

FIG. 15 lists components for the processor circuitry showing specific values of resistors (R), capacitors (C), integrated circuits (IC) and potentiometers (POT).

FIG. 16 lists components specific for each individual block. Block one 10 comprises R 1–8; C 4,5,8 and 9; and IC U1:A,B as shown in FIGS. 5 and 6. Block two 20 comprises R31–37; C15–21; and U6 as shown in FIGS. 5 and 7. Block three 30 comprises POT RV1:A,B as shown in FIGS. 5 and 8. Block four 40 comprises R 9–16; C 5 and 6; and IC U2:A,B and U3:A,B as shown in FIGS. 5 and 9. Block five 50 comprises R 38–44; C 22–27; and U7 as shown in FIGS. 5 and 10. Block six 60 comprises R 17–24; C 7–10; and IC U4:A,B as shown in FIGS. 5 and 11. Block seven 70 comprises R 25, 26; and POT RV2:A,B as shown in FIGS. 5 and 12. Block eight 80 comprises R 27–30; C 11–14; and IC U5:A,B as shown in FIGS. 5 and 13.

Figure 17:
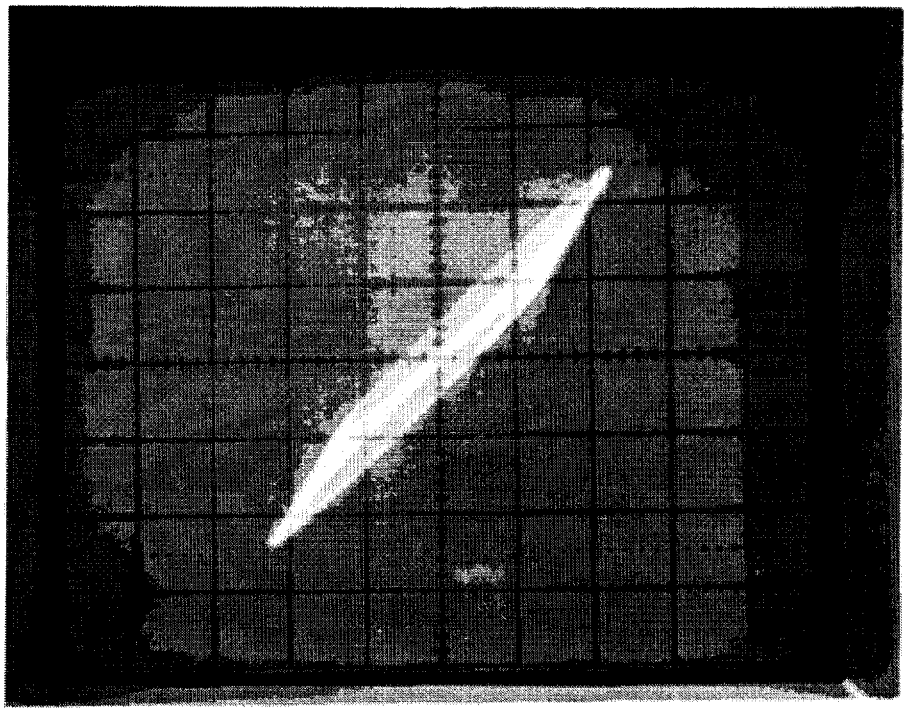
FIG. 17 is a static oscilloscopic monaural signal of 1 KHz mixed with 100 Hz.

FIG. 17 is an oscilloscopic interpretation of a static monaural signal at frequencies set at a mix of 1 KHz and 100 Hz. It shows the lack of depth and width of the signal.

Figure 18:
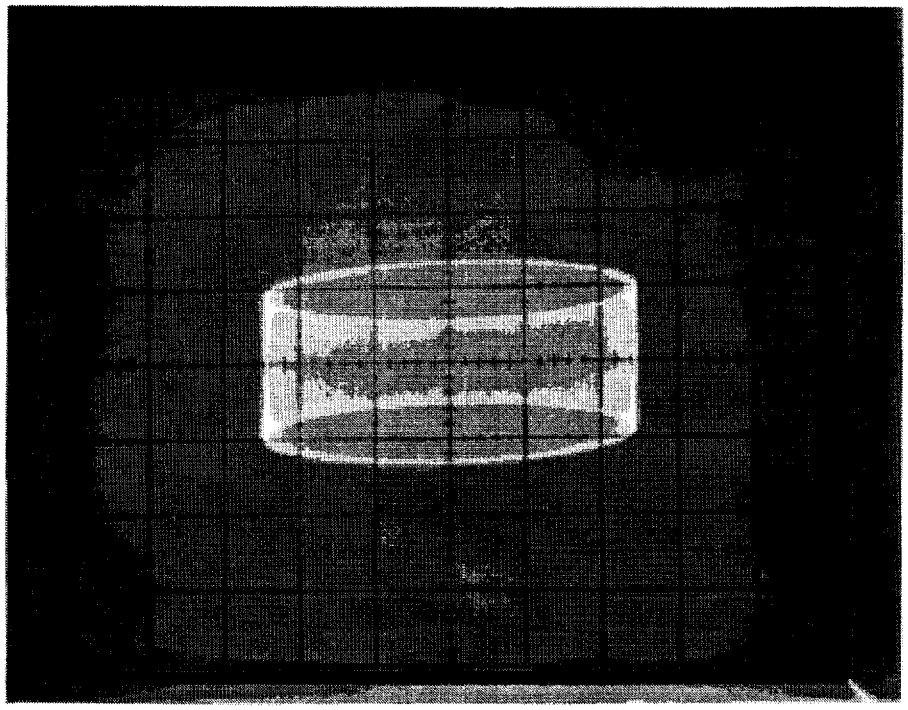
FIG. 18 is a static oscilloscopic stereo signal of 1 KHz mixed with 100 Hz.

FIG. 18 is an oscilloscopic interpretation of a static stereo signal at frequencies set at a mix of 1 KHz and 100 Hz. It shows increased signal depth and width characteristic of a stereo signal.

Figure 19:
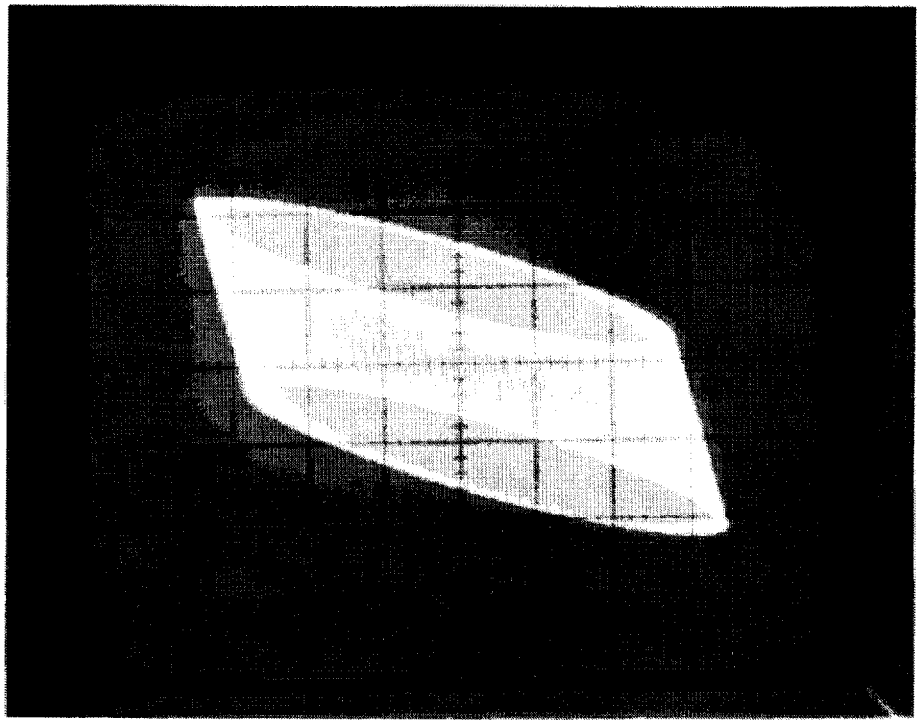
FIG. 19 is a static oscilloscopic spacial signal of 1 KHz mixed with 100 Hz.

FIG. 19 is an oscilloscopic interpretation of a static spacial signal at frequencies set at a mix of 1 KHz and 100 Hz. It shows an expanded depth and width of a spacial signal.

Figure 20:
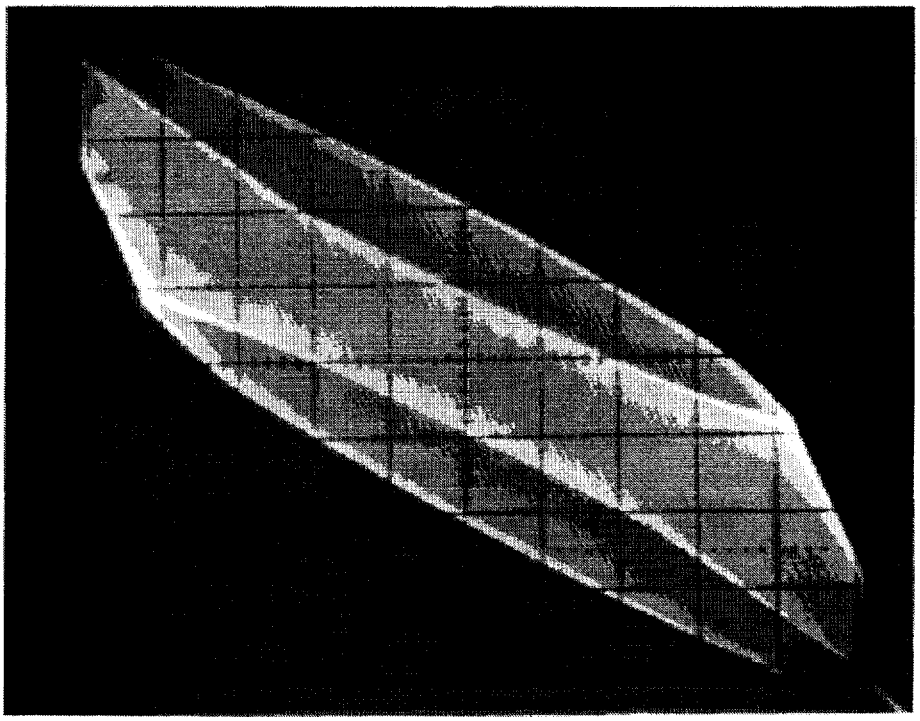
FIG. 20 is a static oscilloscopic binaural signal of 1 KHz mixed with 100 Hz.
Figure 21:
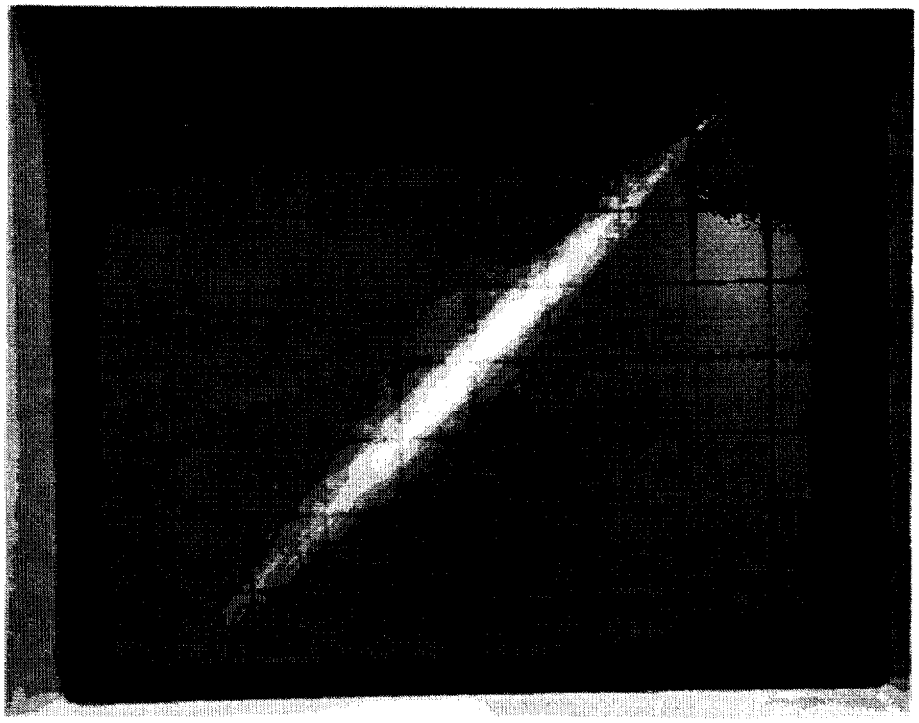
FIG. 21 is a dynamic oscilloscopic monaural signal viewed under music conditions.
Figure 22:
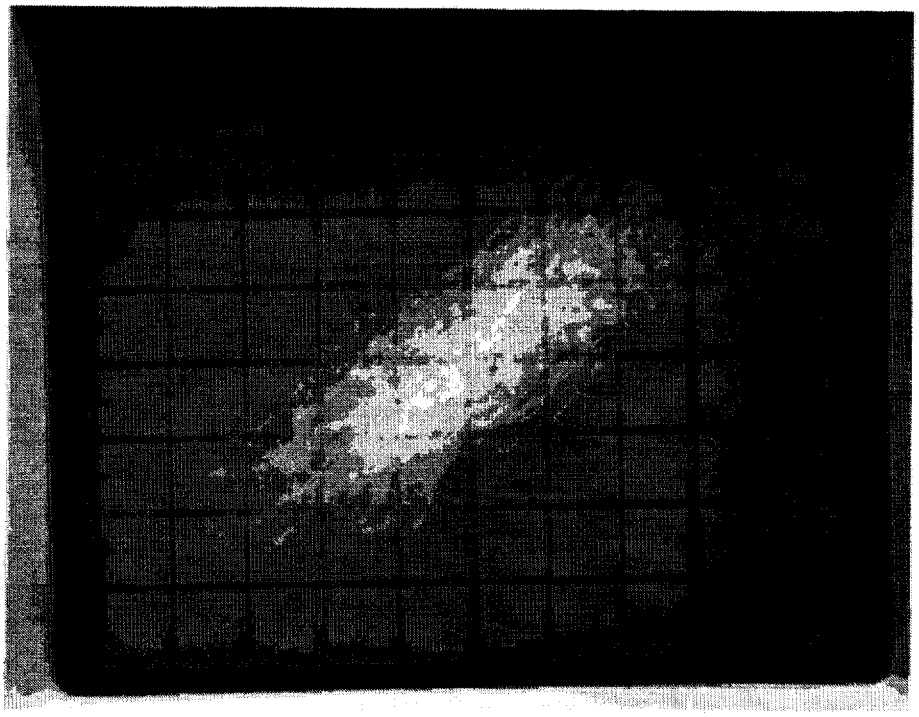
FIG. 22 is a dynamic oscilloscopic stereo signal viewed under music conditions.
Figure 23:
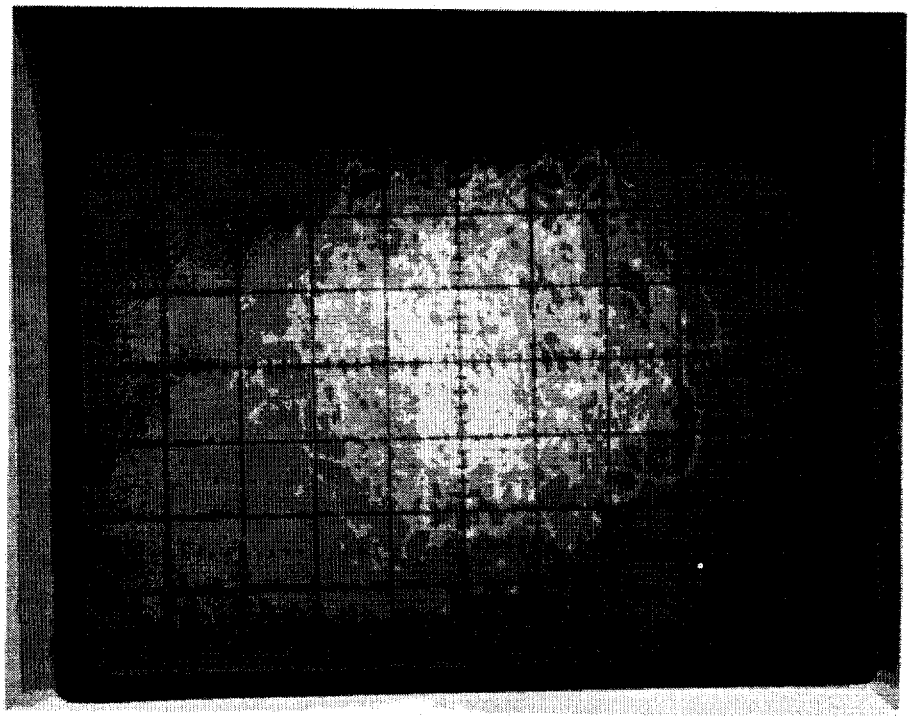
FIG. 23 is a dynamic oscilloscopic spacial signal viewed under music conditions.
Figure 24:
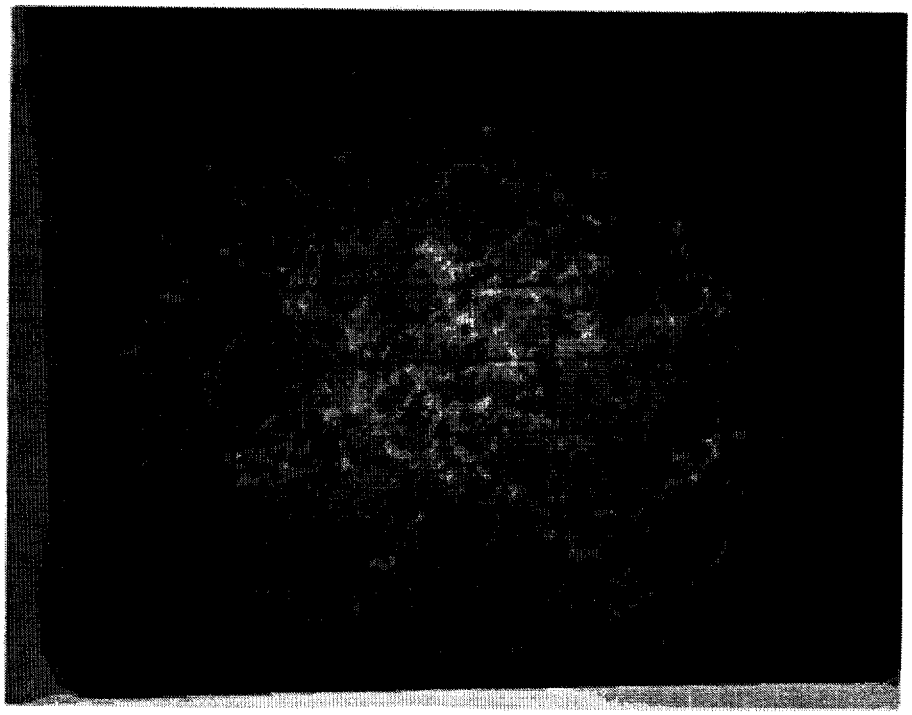
FIG. 24 is a dynamic oscilloscopic binaural signal viewed under music conditions.

FIG. 20 is an oscilloscopic interpretation of a static binaural signal at frequencies set at a mix of 1 KHz and 100 Hz. It shows maximum signal depth and width characteristic of a binaural signal. The static photos were taken from a Techtronics V Oscilloscope Model No. 2235 using a Kodak 400, black and white, film speed print film.

FIGS. 21–24 are dynamic oscilloscopic versions of music signals in a mono, stereo, spacial and binaural interpretation. The dynamic photos were taken from a Techtronics Scope 455 in an XY condition using a Kodak 400, black and white, print film.

Finally, although the invention has been described with reference of particular means, materials and embodiments, it is to be understood that the invention is not limited to the particulars disclosed and extends to all equivalents within the scope of the claims.

What is claimed is:

1. An analog vector processor for producing a binaural signal of an altered sound field wherein signal path connections have right and left channel input and output signals associated therewith, comprising:

a. a first duel-amplifier means for receiving said right and left channel input signals, said first duel-amplifier means producing a signal path which produces a mono signal;

b. a first spacial amplifier means for receiving said right and left channel input signals, said first spacial amplifier to produce a spacial signal;

c. the signal path from said first duel-amplifier means and said first spacial amplifier being connected to a signal mixer control means, said signal mixer control means having a mixer control circuit for mixing right and left channel signals for selecting a mono, stereo, spacial or binaural signal;

d. the signal path from said signal mixer control means being connected to a four-amplifier integrated circuit means for inverting and transposing the signal from the left channel to the right channel and for inverting and transposing the signal from the right channel to the left channel, the resulting inverted and transposed signals being out-of-phase at from 0° to 180°;

e. the signal path from said signal mixer control means being connected to a second spacial amplifier means to produce a spacial signal;

f. the signal path from said four-amplifier integrated circuit means being connected to a second dual-amplifier means providing a non-inverting mixer amplifier to maintain signal integrity in the selected phases;

g. the signal path from said second spacial amplifier means being connected to said second duel-amplifier means;

h. the signal path from said second duel-amplifier means being connected to a level-control means, said level-control means having a laser-trimmed potentiometer for dual tracking of said right and left channel signals; and i. the signal path from said level-control means being connected to a third dual-amplifier means for providing a buffer and having a right channel and a left channel signal path outputs.

2. The processor of claim 1, wherein said signal mixer control has four independent resistors to control impedance of said mixer control.

3. The processor of claim 2, wherein said four independent resistors are at 10 k ohms.

4. A processor for producing a binaural signal of an altered sound field from an analog vector processor having right and left channel input and output signals associated therewith, comprising:

a. a first duel-amplifier means for receiving right and left channel input signals, said first duel-amplifier means having a signal path connected to produce a mono signal;

b. a first spacial amplifier means for receiving right and left channel input signals, said first spacial amplifier means producing an out-of-phase spacial signal;

c. the signal paths from said first duel-amplifier means and from said first spacial amplifier means being connected to a signal mixer control means, said signal mixer control for selecting a signal output in a mono, stereo, spacial or binaural signal;

d. said signal mixer control means having a signal path being connected to a four-amplifier integrated circuit means, said four-amplifier signal path being connected to invert and transpose said signal from the left channel to the right channel and from the right channel to the left channel, said signals being from 0° to 180° out-of-phase;

e. said signal mixer control means having a signal path being connected to a second spacial amplifier means to produce an out-of-phase spacial signal;

f. said four-amplifier integrated circuit means having a signal path connected to a second dual-amplifier means, said second dual-amplifier means being connected as a non-inverting mixer amplifier to maintain input signals in the selected phases;

g. said second spacial amplifier having a signal path being connected to said second dual-amplifier means;

h. said second duel-amplifier means having a signal path connected to a level-control means, said level-control having a laser trimmed potentiometer for dual tracking of right and left channel signals; and i. said level control means having a signal path being connected to a third dual-amplifier means for providing a buffer and having right and left channel signal outputs.

5. The processor of claim 4, wherein said signal mixer control means has four independent resistors to control impedance of said mixer control.

6. The processor of claim 5, wherein said four independent resistors are at 10 k ohms.

7. A method for producing a binaural signal of an altered sound field from an analog vector processor having right and left channel input and output signals associated therewith, comprising the steps of:

a. inputing an audio signal into right and left channels of a first duel-amplifier with the signal path connected to produce a mono signal;

b. inputing an audio signal into said right and left channels of a first spacial amplifier integrated circuit with the signal path connected to produce an out-of-phase spacial signal;

c. connecting the signal path from said first duel-amplifier and from said first spacial amplifier to a signal mixer control for selecting a mono, stereo, spacial or binaural signal;

d. connecting the signal path from said signal mixer control to a four-amplifier integrated circuit for inverting and transposing the signal from said left channel to said right channel and the signal from said right channel to said left channel, thereby producing a signal that is from 0° to 180° out-of-phase;

e. connecting the signal path from said mixer control to a second spacial amplifier;

f. connecting the signal paths from said four-amplifier integrated circuit and from said second spacial amplifier to a second duel-amplifier, said second duel-amplifier having a non-inverting mixer amplifier for maintaining signal integrity in the selected phase degrees;

g. mixing said signals in said second duel-amplifier;

h. connecting the signal path from said second duel-amplifier to a laser-trimmed potentiometer level-control for duel tracking of said signals in said right and left channels; and i. connecting the signal path from said level-control to a third duel-amplifier for providing a buffer and having right and left channel signal outputs.

8. The method of claim 7, wherein said signal mixer control has four independent resistors to control impedance of said mixer control.

9. The method of claim 8, wherein said four independent resistors are at 10 k ohms.

10. An analog vector processor for producing a binaural signal of an altered sound field wherein signal path connections have right and left channel input and output signals associated therewith, comprising:

a. means to process a right and a left channel input signals to produce a mono signal;

b. means to process said right and said left channel input signals to produce an out-of-phase spacial signal;

c. means to control and mix said mono signal and said spacial signal thereby being able to select a mono, stereo, spacial or binaural signal;

d. means to invert and transpose the signals from a control and mix means so that right and left channel signals are from 0° to 180° out-of-phase;

e. means to process the signal from said control and mix means thereby producing an out-of-phase, spacial signal;

f. means to mix an inverted and a transposed signal thereby maintaining the signal integrity of selected signal phases;

g. means to level-control a maintained selected signal phase by dual tracking said signals; and h. means to buffer said signals from a level-control means, said means to buffer having a right and a left channel signal outputs.

* * * * *